United States Patent [19]

Edmonston

[11] Patent Number: 4,971,730

[45] Date of Patent: Nov. 20, 1990

[54] CARBURETOR-AIR DEFLECTOR BAR

[76] Inventor: William H. Edmonston, 22264 Ottawa Rd. - Unit 10, Apple Valley, Calif. 92308

[21] Appl. No.: 393,894

[22] Filed: Aug. 15, 1989

[51] Int. Cl.[5] ..... F02M 9/06

[52] U.S. Cl. ..... 261/44.3

[58] Field of Search ..... 261/44.3, 44.4

[56] References Cited

U.S. PATENT DOCUMENTS

| | | | |
|---|---|---|---|
| Re. 31,475 | 12/1983 | Edmonston | 261/44.3 |
| 2,052,225 | 8/1936 | Hartshom | 261/44.3 |
| 3,985,839 | 10/1976 | Edmonston | 261/44.3 |
| 4,013,741 | 3/1977 | Edmonston | 261/44.3 |
| 4,257,379 | 3/1981 | Hickling | 261/44.3 |
| 4,442,046 | 4/1984 | Edmonston | 261/44.3 |
| 4,472,322 | 9/1984 | Isoya | 261/44.4 |

FOREIGN PATENT DOCUMENTS

| | | | |
|---|---|---|---|
| 593887 | 3/1934 | Fed. Rep. of Germany | 261/44.3 |
| 663071 | 8/1929 | France | 261/44.3 |
| 368551 | 6/1939 | Italy | 261/44.3 |
| 63-109274 | 5/1988 | Japan | 261/44.4 |
| 63-159654 | 7/1988 | Japan | 261/44.3 |

*Primary Examiner*—Tim Miles

*Attorney, Agent, or Firm*—Frank P. Presta

[57] ABSTRACT

A carburetor of the slide and metering rod type is characterized by the provision of an air deflecting bar in the carburetor throat adjacent the metering rod for deflecting the flow of air from the inlet end of the carburetor around the metering rod to reduce turbulence and increase air velocity by compressing the air flow. The deflecting bar has a wedge configuration with the pointed edge thereof facing in the direction of the inlet end. The bar may be permanently mounted within the throat or connected with the carburetor throttle slide member.

10 Claims, 3 Drawing Sheets

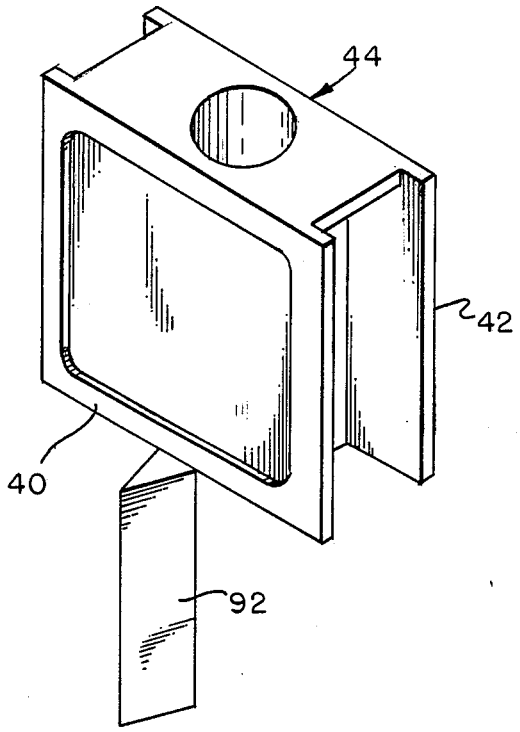
FIG. 3
FIG. 6
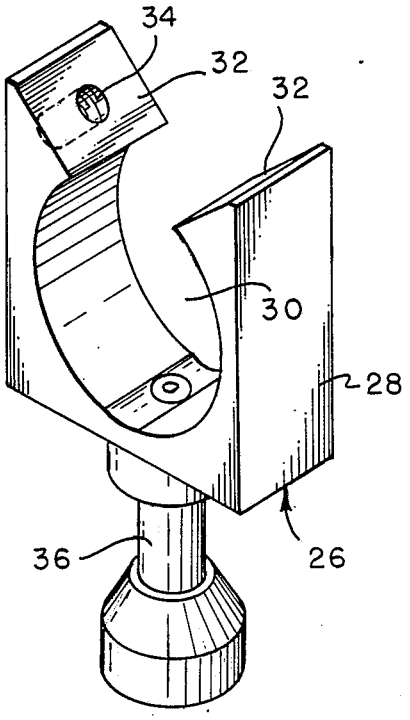
FIG. 7
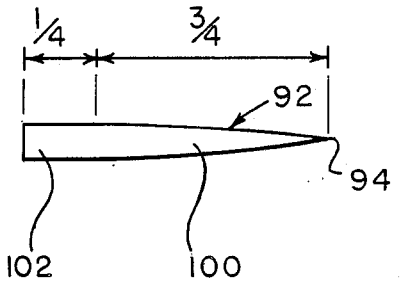

CARBURETOR-AIR DEFLECTOR BAR

BACKGROUND OF THE INVENTION

The present invention relates to a carburetor of the slide and metering rod type, and more particularly to an air deflector assembly arranged within the carburetor throat to enhance the flow of air from the carburetor inlet around the metering rod in order to reduce turbulence and increase air velocity at the fuel outlet by compressing the air flow. This provides more precise fuel control and an optimum air/fuel ratio for more power with fuel conservation.

BRIEF DESCRIPTION OF THE PRIOR ART

Carburetors of the slide and metering rod type are well-known in the patented prior art, as evidenced by the inventor's prior U.S. Pat. Nos. 3,985,839, 4,013,741, 4,442,046 and Re. 31,475.

As disclosed in the aforementioned reissue patent, for example, these carburetors include a body having air inlet and outlet ends and a throat extending therebetween. A throttle slide member is slidably mounted on the body within the throat, and a tapered metering rod or needle is connected with the slide member and extends downwardly into a fuel supply tube connected with a fuel reservoir mounted beneath the body. The slide member has front and rear substantially flat panels disposed in substantially parallel relation. The metering rod is provided with a downwardly and inwardly tapered rear flat face and is mounted for longitudinal adjustment relative to the slide member.

One drawback of the aforementioned carburetor is that the flow of air through the throat includes a great deal of turbulence at the metering rod and across the outlet of the fuel supply tube. This turbulence results in an uneven draw of fuel from the fuel supply tube, thereby producing an inconsistent air/fuel mixture within the carburetor.

The present invention was developed in order to overcome this and other drawbacks of the prior slide and metering rod type carburetors by providing an air deflector mechanism within the carburetor throat to deflect the flow of air around the metering rod and fuel supply tube outlet in order to reduce turbulence and increase air velocity by compressing the air flow.

SUMMARY OF THE INVENTION

Accordingly, it is a primary object of the present invention to provide a carburetor including a body having an air inlet end, an air outlet end, and a throat extending between the inlet and outlet ends. A fuel supply tube is connected with the body and has an outlet communicating with the throat. A throttle slide member is movably mounted within the body intermediate the inlet and outlet ends for transverse movement across the throat to vary an unblocked portion thereof. An air deflection device is arranged in the throat adjacent the metering rod on the inlet end side thereof for deflecting the flow of air from the inlet end around the metering rod to reduce turbulence and increase air velocity by compressing the air flow.

The air deflection device comprises a wedge-shaped bar extending transversely across the throat and having a pointed edge in the direction of the body inlet end and having side walls which taper outwardly and rearwardly.

According to a first embodiment, the deflecting bar is mounted on the body in the throat area thereof in front of the metering rod.

In a second embodiment, the deflecting bar is connected with and extends downwardly from the lower front edge of the throttle slide member. When the slide is raised toward its open position, the deflecting bar is positioned within the body throat. When the throttle is lowered to its closed position, the deflecting bar enters a recess in the bottom of the body extending into the fuel reservoir.

BRIEF DESCRIPTION OF THE DRAWINGS

Other objects and advantages of the invention will become apparent from a study of the following specification when viewed in the light of the accompanying drawings, in which:

FIG. 3 is a perspective view of the throttle slide member with the deflector bar connected therewith in accordance with a second embodiment of the invention;

FIG. 6 is a perspective view of the insert of the carburetor of the present invention; and FIG. 7 is an enlarged plan view of the deflector bar of FIG. 2.

DETAILED DESCRIPTION

Figure 1:
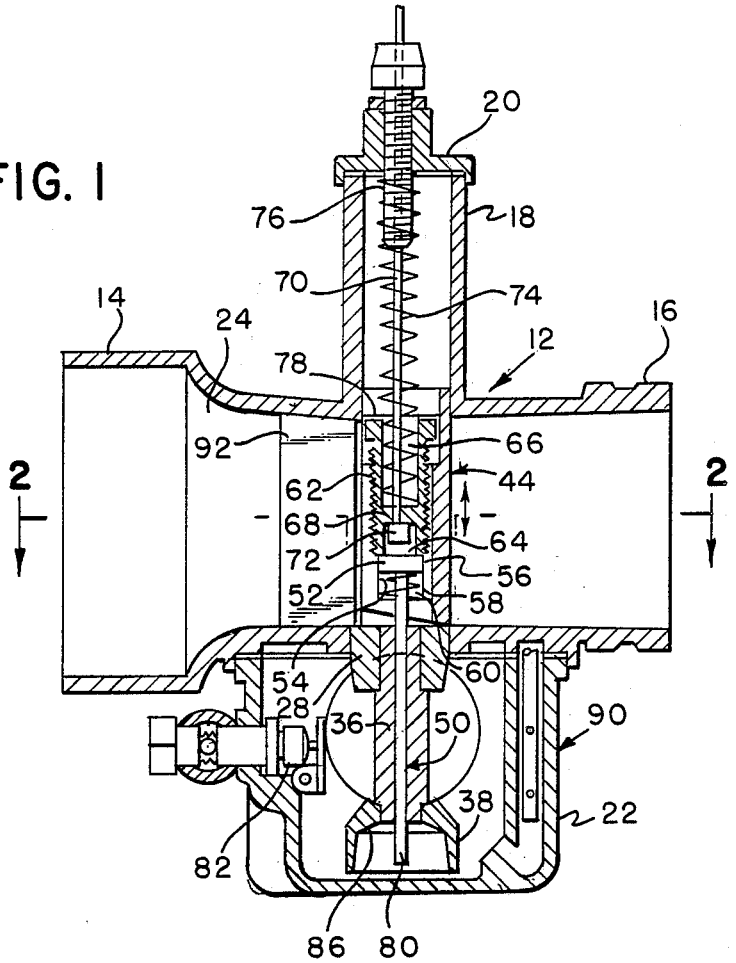
FIG. 1 is a side elevational view in section of a carburetor including the air deflector bar according to a first embodiment of the invention.

Referring to FIG. 1, the carburetor 10 of the present invention generally comprises a body 12 having an air inlet end 14, an air outlet end 16 and a centrally located slide supporting portion 18; a cover 20 adapted to fit over the upper portion of the slide supporting portion 18; and a fuel reservoir or bowl 22 secured to the underside of the body beneath the slide supporting portion 18. Preferably, the inlet end 14, outlet end 16 and slide supporting portion 18 are formed of unitary construction, and a throat 24 extends through the body from one end to the other. The cover 20 and reservoir 22 may be removably secured to the body 12 in any suitable manner, such as by flexible and resilient spring members, not shown.

Figure 2:
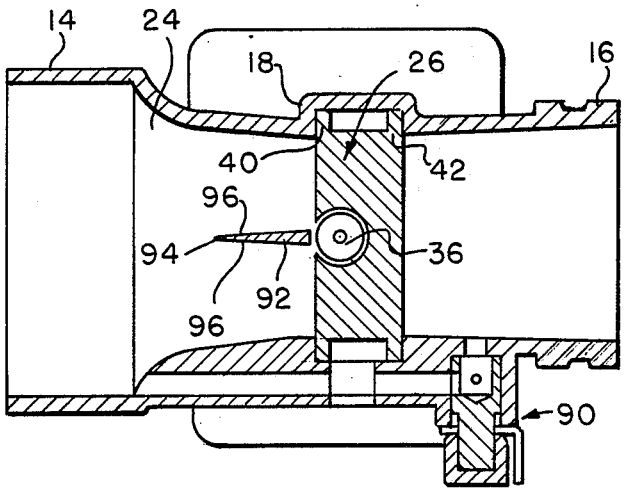
FIG. 2 is a sectional view of the carburetor taken along lines 2—2 of FIG. 1.

As specifically shown in FIGS. 1, 2, and 6, the body 12 is provided with an insert 26 fixedly mounted by a locking screw within the slide supporting portion 18. The insert 26 comprises an upper yoke portion 28 having an aperture 30 therethrough that corresponds in size and shape to the adjacent portions of the throat 24 in the body 12. The upper end of the upper insert yoke portion 28 is open and comprises oblique end faces 32, one of which has a threaded aperture 34 extending therethrough which is adapted to receive the locking screw in a conventional manner. A fuel supply tube 36 is secured to the bottom of the upper portion 28 and extends through an aperture therein into communication with the aperture 30. The fuel supply tube 36 extends downwardly into the fuel reservoir or bowl 22 and is provided at its lower end with an outwardly and downwardly extending flange or "umbrella" portion 38 disposed near the lower end of the bowl 22 for a purpose to be more fully described hereinafter.

As shown in FIG. 2, the insert 26 is narrower than the adjacent portions of the slide supporting portion 18 so as to define grooves on each side of the slide supporting portion that are adapted to slidably receive the side edge portions of the front and rear panels 40 and 42 of a throttle slide member 44 mounted within the slide supporting portion 18 for substantially vertical slidable movement therein as shown in FIG. 1. At its upper portion, the slide member 44 is provided with a pair of downwardly facing oblique surfaces which are adapted to engage the complementary oblique faces 32 on the upper end of the insert 26 for the purpose of limiting the downward movement of the slide member 44 within the slide supporting portion 18 of the body 12. The locking screw can be adjusted to engage one of the oblique surfaces on the slide member 44 for the purpose of adjusting the lowest position of the slide member. In addition to the locking screw, the insert 26 may be retained within the slide supporting portion 18 by locking pins, not shown.

A fuel metering rod or needle 50 is adjustably secured to and extends downwardly from the slide member 44, through the fuel supply tube 36 and into the flange portion 38 thereof disposed near the bottom of the reservoir or bowl 22. The metering rod 50 is provided with an enlarged head portion 52 at its upper end which is slidably received within a bore 54 in the slide member 44. As shown in FIG. 1, the bore 54 preferably is near or at the front panel 40 of the throttle slide member 44 for a purpose to be described hereinafter. The head portion 52 is provided with a key portion 56 that is receivable within a complementary groove 58 in the slide member bore 54 for the purpose of maintaining the metering rod 50 in a desired orientation which will be more fully described hereinafter. A coil spring 60 or other biasing means is provided between the bottom of the slide member bore 54 and the lower surface of the head portion 52 of the metering rod 50 and serves to urge the head portion 52 upwardly away from the lower end of the bore 54, as specifically shown in FIG. 1.

An adjusting screw 62 is threadably mounted within an upper threaded portion of the slide member bore 54 and has a lower end in engagement with the upper surface of the enlarged head portion 52 of the metering rod 50. The adjusting screw 62 is provided with a lower internal bore 64 and an upper internal bore 66 which are separated by an intermediate flange portion 68 having an aperture therethrough extending between the lower bore 64 and the upper bore 66. A control cable 70 for the throttle slide member 44 extends through the upper bore 66 in the adjusting screw 62 and through the aperture in the intermediate flange 68. The control cable 70 is provided with an enlarged head portion 72 at its lower end which is disposed within the lower bore 64 in the adjusting screw 62 and is in engagement with the intermediate flange 68 for the purpose of connecting the cable 70 to the adjusting screw 62 and to the throttle slide member 44. A helical spring 74 surrounds the cable 70 and extends from the lower end of the upper bore 66 and the adjusting screw 62 to the upper end of the slide supporting portion 18. At its upper end, the helical spring 74 surrounds the lower end of a tube 76 extending downwardly from and threadably secured in an aperture in the cover 20 for the slide supporting portion 18. The cable 70 extends through the tube 76 and the cap member 20 for connection to any suitable type of manual control means disposed on the vehicle in which the carburetor is mounted. The helical spring 74 serves to urge the slide member 44 to the closed or down position shown in FIGS. 1 and 4 wherein it cuts off air flow through the throat 24 of the body 12. Upward movement of the cable 70 serves to move the slide member 44 upwardly against the force of the spring 74 to allow air flow through the throat 24 and upward movement of fuel from the reservoir 22 through the fuel supply tube 36 in a manner to be described more fully hereinafter.

The vertical position of the metering rod or needle 50 relative to the slide member 44 may be easily adjusted by rotation of the adjusting screw 62 which is provided at its upper end with a transverse recess 78 or the like for receiving the head of a screwdriver or similar tool. Rotation of the adjusting screw 62 serves to move the head portion 52 of the metering rod 50 upwardly or downwardly within the lower portion of the bore 54 in the throttle slide member 44.

The metering rod or needle 50 is provided with a downwardly and inwardly tapered flat portion 80 extending from the upper portion to the lower end thereof. The key portion 56 is so located on the enlarged head portion 52 of the metering rod 50 that the flat portion 80 faces the outlet end 16 of the carburetor body 12 when the metering rod 50 is mounted within the throttle slide member 44, as specifically shown in FIG. 2. It will be readily seen, therefore, that upward movement of the slide member 44 and corresponding upward movement of the metering rod 50 within the fuel supply tube 36 will cause a gradually larger opening at the outlet of the fuel supply tube for the supply of fuel from the fuel reservoir or bowl 22 to the carburetor throat 24, owing to the tapered flat portion 80 on the metering rod. By varying the taper of the flat portion 80 on the metering rod 50, the variation in fuel flow for a given upward movement of the slide member 44 and metering rod 50 may be adjusted.

As shown in FIGS. 1 and 2, the inner surface of the carburetor body 12 is tapered inwardly from the inlet end 14 to the slide supporting portion 18 and is tapered outwardly from the slide supporting portion 18 to the outlet end 16, thereby creating a Venturi effect when air flows through the carburetor throat from the inlet to the outlet end. This air flow past the metering rod 50 and outlet end of the fuel supply tube 36 serves to create a vacuum at the outlet of the fuel supply tube, thereby causing a flow of fuel from the fuel reservoir or bowl 22 upwardly through the opening in the fuel supply tube defined by the metering rod 50 and into the carburetor throat 24 where the fuel is mixed with incoming air and moves toward the outlet end therewith. The fuel flows upwardly from the fuel reservoir 22 into the fuel supply tube 36 because the reservoir 22 is vented to the atmosphere in a manner to be more fully described hereinafter.

The fuel reservoir bowl 22 is provided with a suitable float valve assembly 82 or any other suitable means for maintaining a minimum quantity of fuel in the reservoir. The float valve assembly 82 is connected to a fuel supply tube in any suitable manner.

The downwardly extending flange portion 38 on the lower end of the fuel supply tube 36 serves to trap fuel within it and to keep air from entering the fuel supply tube when the carburetor is subjected to vibration owing to travel of the vehicle over rough terrain or the like. By trapping fuel within it, the flange portion 38 also serves to reduce turbulence in the fuel entering the lower end of the fuel supply tube. A smooth supply of fuel to the lower end of the fuel supply tube 36 is further enhanced by the upwardly and inwardly tapered inner surfaces 86 of the flange portion 38 which lead to the lower end of the fuel supply tube.

It will be appreciated that upward and downward movement of the throttle slide member 44, as actuated by the control cable 70, serves to control the air flow from the inlet end to the outlet end of the carburetor body 12 and also serves to control the flow of fuel from the fuel reservoir or bowl 22 to the carburetor throat 24 because of corresponding upward or downward movement of the metering rod 50 secured to the throttle slide member 44. A significant feature of the carburetor is to maximize air flow past the metering rod to assure thorough atomization and distribution of the fuel in the airstream before it reaches the combustion chamber.

A choke assembly 90 is also provided which allows extra fuel to be atomized and to enter the carburetor throat when desired. The choke assembly is shown in FIGS. 1, 2, 4, and 5 and is similar to that described in the inventor's prior U.S. Pat. No. Re. 31,475.

In accordance with a first embodiment of the invention, a deflecting bar 92 is mounted in the throat 24 of the carburetor body 12 as shown in FIGS. 1 and 2. The deflecting bar is vertically arranged transversely across the throat and has a pointed forward edge 94 which faces in the direction of the inlet end and side walls 96 which taper outwardly and rearwardly to provide the bar with a wedge shape. The rear end portion of the bar 92 preferably is near the front panel of the slide member and is only slightly wider than the metering rod 50.

The bar 92 deflects the flow of air from the inlet end around the metering rod 50 to reduce the turbulence and increase air velocity by compressing the air flow. More particularly, when the slide member 44 is moved to its open position, as shown for example in FIG. 5, the metering rod 50 is arranged behind the deflecting bar 92. The bar thus deflects the air flow around the metering rod, thereby increasing the air flow past the rod in a non-turbulent manner to enable the air/fuel mixture to be more precisely controlled. The precise flow of fuel from the supply tube results in a more consistent air/fuel mixture and fuel economy.

Figure 5:
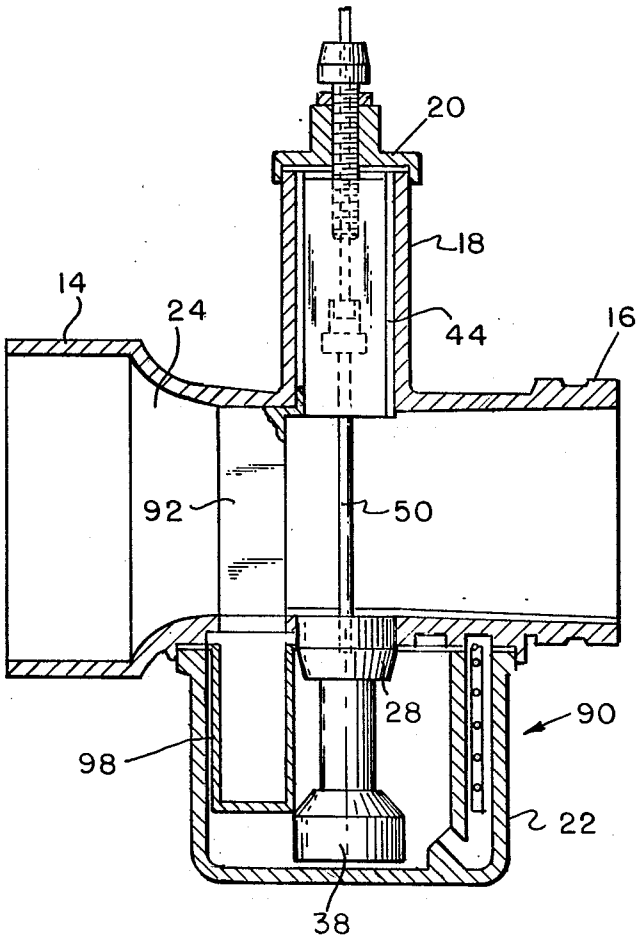
FIGS. 4 and 5 are side elevational views in section of the carburetor including the slide member of FIG. 3 in its closed and open positions, respectively.
Figure 4:
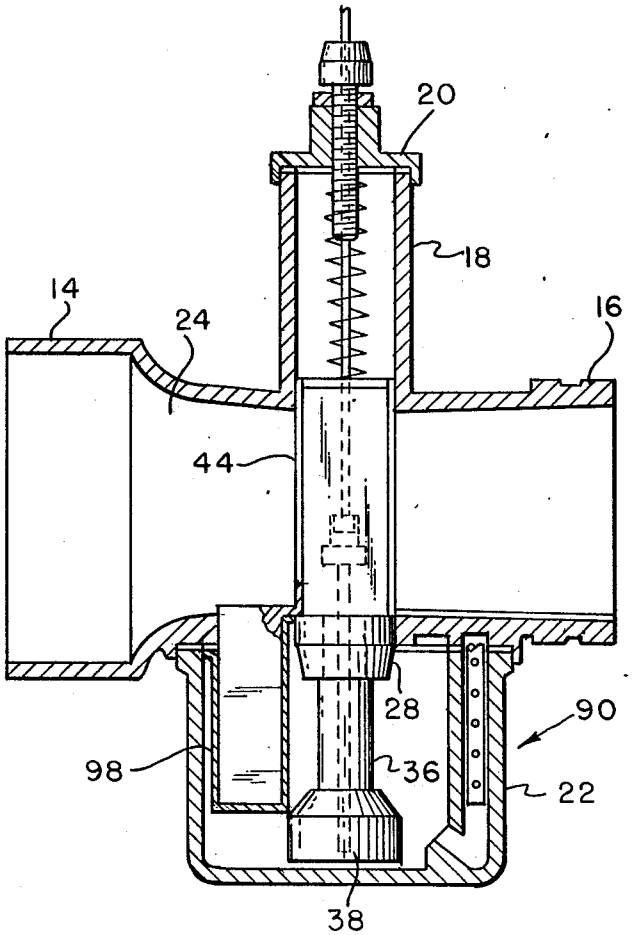

Referring now to FIGS. 3, 4, and 5, a second embodiment of the air deflecting bar 92 will be described. As shown in FIG. 3, the bar 92 is connected with the lower edge of the front panel 40 of the throttle slide member 44 and thus moves with the slide member as shown in FIGS. 4 and 5. When the slide member is in its closed position (FIG. 4), the deflecting bar is arranged in a recess 98 provided in the bottom of the carburetor body 12 extending into the fuel reservoir 22. As the slide member is raised toward its open position (FIG. 5), the deflecting bar is raised out of the recess to its operating position forward of the metering rod 50.

The deflecting bar 92 preferably is narrow in width and only slightly larger in width at its rear end portion than the width of the metering rod 50. As an illustrative example, for a rod that is 125/1,000 of an inch wide, the deflecting bar 92 would be approximately one inch in length and 130/1,000 of an inch wide at its rear end portion. Also, the rear end portion of the deflecting bar 92 would be spaced approximately $\frac{1}{4}$ inch or less forwardly of the rod 50.

This spacing is facilitated by the location of the bore 54 near or at the front panel 40 of the slide member 44 which positions the metering rod 50 near the front panel 40.

As shown in FIG. 7, the rear portion of the deflecting bar 92 preferably is straight for approximately $\frac{1}{4}$ of its total length to create longitudinal air flow and thus reduce turbulence at the metering rod 50. Accordingly, the deflecting bar is tapered for approximately $\frac{3}{4}$ of its length and the transition from the tapered front portion 100 to the straight rear portion 102 is very gradual and even to further minimize air turbulence. For this purpose, the exterior surface of the tapered front portion 100 may be slightly curved to aid in a smooth transition to the straight rear portion 102.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A carburetor, comprising (a) a body having an air inlet end, an air outlet end, and a throat extending therethrough from said inlet end to said outlet end;

(b) a fuel supply tube connected with said body and having an outlet in communication with said throat;

(c) a throttle slide member movably mounted within said body intermediate said inlet and outlet ends thereof for substantially transverse movement across said throat to vary an unblocked portion thereof;

(d) a metering rod extending downwardly into said fuel supply tube to control the supply of fuel therethrough; and (e) means arranged in said throat adjacent said metering rod on the inlet end side thereof for deflecting the flow of air from said inlet end around said metering rod to reduce turbulence and increase air velocity by compressing the air flow, said flow deflecting means comprising a wedge shaped bar extending transversely across said throat, said bar having a pointed edge in the direction of said inlet end and having side walls which taper outwardly and rearwardly.

2. Apparatus as defined in claim 1, wherein said fuel supply tube is connected with the underside of said body and further wherein said metering rod is connected with said throttle slide member, said metering rod being arranged behind said deflecting bar when said slide member is moved to an open position, said bar deflecting the air flow around said metering rod, thereby creating an enhanced vacuum behind said metering rod to draw fuel more rapidly from said fuel supply tube.

3. Apparatus as defined in claim 2, wherein said deflecting bar is connected with and extends downwardly from the lower front edge of said throttle slide member, said body containing a recess in the bottom thereof for receiving said deflecting bar when said slide member is in a closed position.

4. Apparatus as defined in claim 1, wherein the front portion of said bar is tapered and the rear portion of said bar is substantially straight to create substantially longitudinal air flow at said metering rod.

5. Apparatus as defined in claim 4 wherein the length of said tapered front portion is approximately three quarters of the total length of the bar and the length of said substantially straight rear portion is approximately one quarter of the total length of the bar.

6. Apparatus as defined in claim 5 wherein there is a smooth transition from said tapered front portion to said substantially straight rear portion to minimize air turbulence.

7. Apparatus as defined in claim 1 wherein the rear end portion of said bar is only slightly greater in width than the width of said metering rod.

8. Apparatus as defined in claim 7 wherein the rear end portion of said bar is approximately 5/1,000 of an inch wider than said metering rod.

9. Apparatus as defined in claim 1 wherein said bar is spaced no more than one quarter of an inch in front of said metering rod.

10. Apparatus as defined in claim 1 wherein the rear end portion of said bar is located closely adjacent to the front panel of said slide member.

* * * * *